United States Patent [19]

Pohl

[11] Patent Number: 4,533,202

[45] **Date of Patent: * Aug. 6, 1985**

[54] MULTIPLE ELECTRICAL CONNECTOR AND BLOCK WITH PRINTED CIRCUIT BOARD CONNECTOR CLIP

[75] Inventor: Karl-Heinz Pohl, Buffalo, Minn.

[73] Assignee: The Siemon Company, Watertown, Conn.

[ * ] Notice: The portion of the term of this patent subsequent to Jan. 10, 2001 has been disclaimed.

[21] Appl. No.: 537,069

[22] Filed: Sep. 29, 1983

[51] Int. Cl.[3] ..... H01R 9/09

[52] U.S. Cl. ..... 339/176 MP; 339/97 R

[58] Field of Search ..... 339/97 R, 97 P, 217 S, 339/176 MP

[56] References Cited

U.S. PATENT DOCUMENTS

| | | | |
|---|---|---|---|
| 3,132,913 | 5/1964 | Pohl | 339/198 S |
| 3,654,592 | 4/1972 | Primorac | 339/176 MP |
| 4,068,915 | 1/1978 | Evans | 339/176 MP |
| 4,127,317 | 11/1978 | Tyree | 339/176 MP |
| 4,226,496 | 10/1980 | Langham | 339/176 MP |
| 4,381,880 | 5/1983 | Pohl | 339/97 P |
| 4,425,019 | 1/1984 | Pohl | 339/97 R |

*Primary Examiner*—John McQuade

*Attorney, Agent, or Firm*—Fishman & Dionne

[57] ABSTRACT

A mounting block is presented for interconnecting solderless connectors to a printed circuit board. The mounting block for solderless connectors has a retainer and a body section which defines slots for housing terminal defining conductive elements. Incorporated on the retainer section is a connector clip which provides mechanical and electrical connection between the solderless connector loops and a conventional printed circuit board.

15 Claims, 5 Drawing Figures

MULTIPLE ELECTRICAL CONNECTOR AND BLOCK WITH PRINTED CIRCUIT BOARD CONNECTOR CLIP

BACKGROUND OF THE INVENTION

This invention relates to the field of multiple electrical connectors and mounting blocks therefor. More particularly, this invention relates to a mounting block for wire formed solderless multiple connectors of the type shown in my prior U.S. Pat. No. 4,381,880 wherein a novel connector clip may be incorporated therein which provides mechanical and electrical connection to a conventional printed circuit board.

My earlier U.S. Pat. No. 3,132,913 relates to a solderless multiple connector formed from continuous strips of wire formed and shaped in adjacent and abutting loops so as to receive and electrically contact electrically conductive wire between abutting sections of loops. The wire formed solderless connector shown in my prior U.S. Pat. No. 3,132,913 was intended as an improvement on and had several advantages over prior art clip type connectors of the type generally shown in U.S. Pat. No. 3,112,147 (of which I am a coinventor) and which are referred to in the art as "66 Type" connectors.

My subsequent U.S. Pat. No. 4,381,880 is an improvement over deficienies in U.S. Pat. No. 3,132,912. U.S. Pat. No. 4,381,880 relates to a mounting block for solderless connectors having a retainer and a body section which defines slots for housing terminal defining conductive elements. These conductive elements are formed from wire to define linearly aligned plural loops between which wires may be inserted. The conductive elements are arranged in uniformly spaced horizontal rows and vertical columns of terminals.

In the field of electronics, there are numerous applications and types of instrumentation where it is desirable to connect multiple electrical connectors as described in U.S. Pat. No. 4,381,880 to conventional printed circuit boards. Unfortunately, no acceptable device exists in the prior art which easily and inexpensively accomplishes this interconnection. It would therefore be extremely advantageous to provide such a connecting device which would efficiently connect solderless multiple connectors to printed circuit boards.

SUMMARY OF THE INVENTION

The above discussed and other problems of the prior art are overcome by the printed circuit board connecting clip of the present invention. In accordance with the present invention, a connector clip capable of mechanically and electrically connecting a conventional printed circuit board to a solderless connector of the multiple terminal type is presented.

The connector clip of the present invention comprises a pair of electrically conductive cane-shaped metal pins. The rod shaped body portion of the cane-shaped pin extends through a retainer and makes an electrical and mechanical connection between adjacent loops of the solderless connector in the block. The curved head portion of the pins have diverging contact portions. A pair of pins having their respective contact portions inwardly facing or opposing each other will act as bias elements upon insertion of an object therebetween. These opposing bias elements are spaced apart to define a space slightly narrower than the thickness of a standard printed circuit board. Thus, upon insertion of a printed circuit board therebetween, the bias elements of the pins are forced apart with the resulting spring force tightly holding the circuit board therein while also permitting electrical contact. In a preferred embodiment, the pins have a detent mechanism which secures the pins tightly within the retainer as well as monitoring the length of the pins which is caught between the wire loop connectors. Preferably, a U-shaped guide member is also formed onto each pin of the connector clip in order to insure precise insertion within the retainer. As indicated, the connector clip of the present invention is associated with a multiple terminal solderless electrical connector and a mounting block as described in my U.S. Pat. No. 4,381,880 which is assigned to the assignee hereof and incorporated herein by reference.

The multiple terminal solderless electrical connector is formed from a length of wire. The wire is alternately looped to form two oppositely facing rows of loops. A first row of loops is formed with relatively straight parallel sides, while the second row of loops, which interconnect the loops of the first row, is formed with inwardly converging sides. The loops of the first row are configured so that the straight side portions of adjacent loops are in intimate contact to form an individual connector. The loops in the second row are spatially separated from each other.

The mounting block is provided with slots for receiving the wire connectors. The dimensions of the slots are such so that the wire connectors are prevented from lateral movement and constrained from any type of displacement. The connectors are positioned within the mounting blocks so that the first row of loops is exposed for receiving wire conductors. The mounting block is further provided with a plate for retaining the connectors within the blocks. This plate supports at least two printed circuit board connector pins that are positioned to be engaged between the spatially separated loops of the second row. The gap between the loops is such so that a firm engagement with the connector pins is effected.

BRIEF DESCRIPTION OF THE DRAWINGS

Referring now to the drawings, wherein like elements are numbered alike in the several FIGURES:

FIG. 2 is an exploded view of the connector clip and retainer portion of. FIG. 1 in accordance with the present invention.

DESCRIPTION OF THE PREFERRED EMBODIMENT

Figure 1:
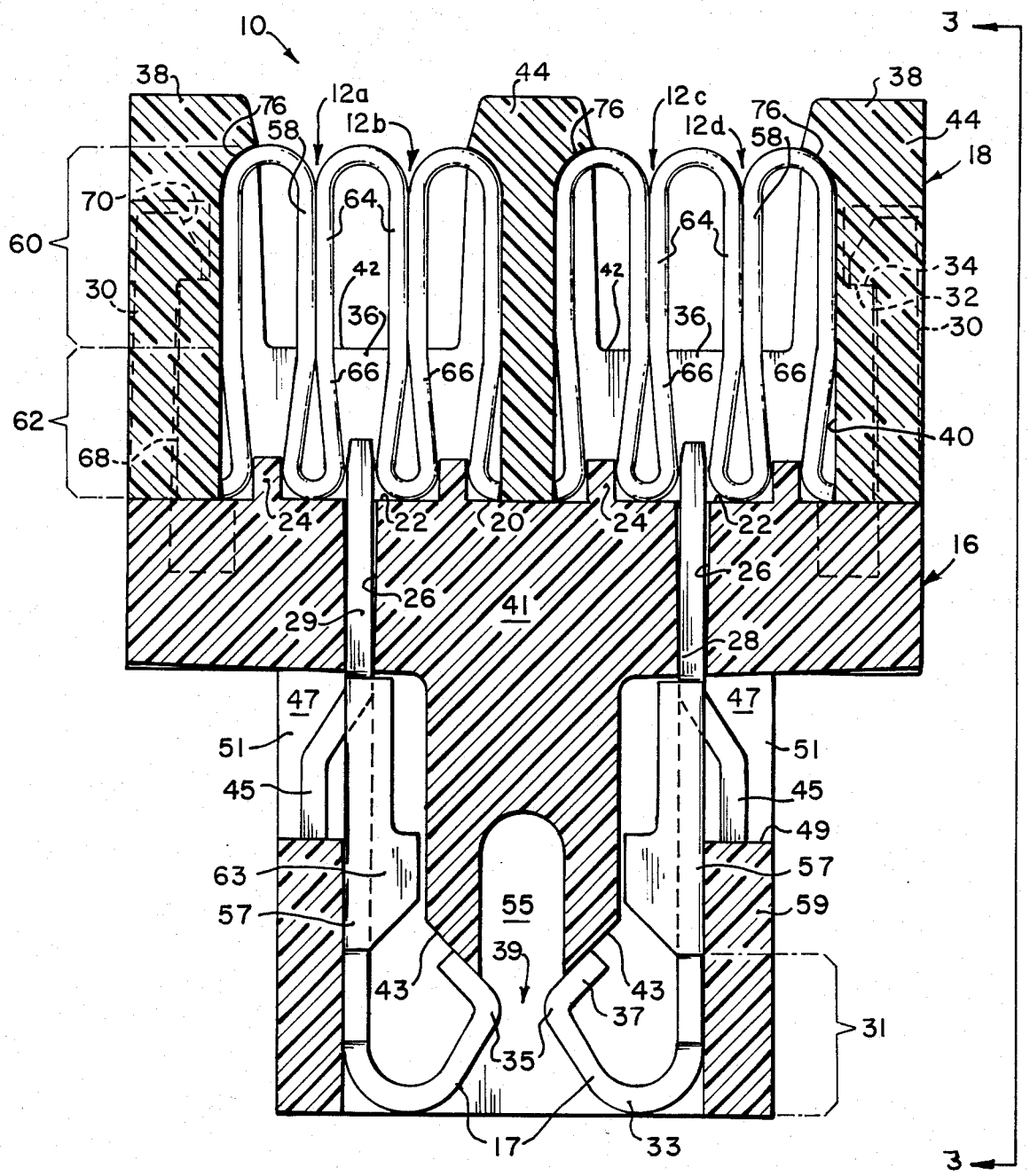
FIG. 1 is a side elevation view, partly in cross-section, of the two portions of a connector block in assembled form and with a printed circuit board connector clip installed, in accordance with the present invention.
Figure 4:
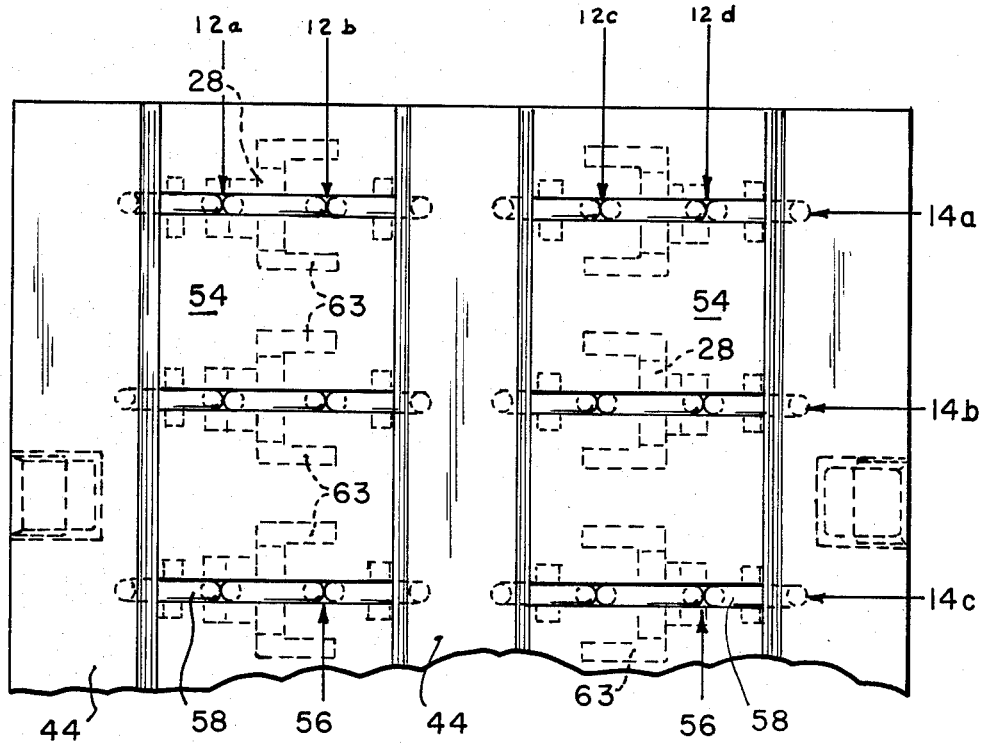
FIG. 4 is a top plan view of the connector block of FIG. 1 in accordance with the present invention.

FIGS. 1 and 4 show a block, generally indicated at 10, for 12 connector locations, arranged in a four by three array. That is, front to back of the block there are four columns of connector locations, each of which has three solderless connector elements or sites. Block 10 also contains three rows of solderless connector elements or sites, each row having two groups of two connectors sites. Each group of two connector elements or sites is electrically disconnected from the other, unless an external connection is made. While the details which make up these four columns and three rows will be discussed in more detail hereinafter, the four columns are generally indicated at 12(*a*) through 12(*d*) in FIG. 4, and the three rows are generally indicated at 14(*a*) through 14(*c*) in FIG. 4. Of course, it will be understood that any desired number of rows and columns can be used, and the four by three array is merely for purposes of illustration.

Figure 2:
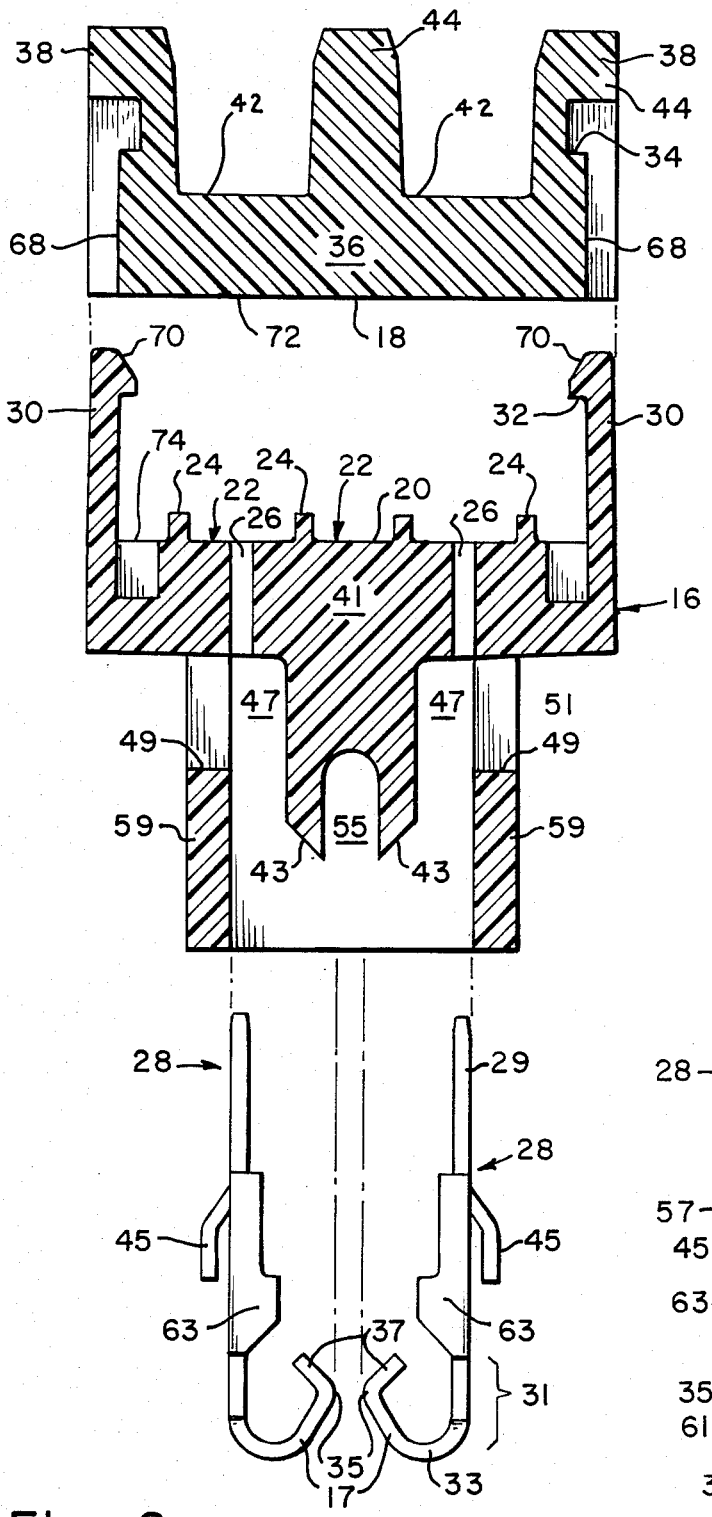

Block 10 is comprised of two basic interlocking parts. These two parts are a retainer 16 with a printed circuit board receiving means or connector clip incorporated therein and a main body unit 18. For purposes of clarity and understanding, retainer 16, connector clip or receiving means 17 and main body unit 18 are separately shown in FIG. 2. FIG. 2 thus depict separate parts of the assembled unit shown in FIGS. 1–5. Retainer 16 has a base portion 20 with a series of latitudinal (side to side) interrupted slots 22 therein corresponding to the number of conductive connector elements to be housed in the block. Retainer 16 is also provided with a series of upstanding spacer members 24 which are integral with retainer 16 and extend upwardly from the face of the slots 22. The spacers 24, which constitute interruptions in slots 22, are arranged in a predetermined pattern. In those areas of the slots 22 in retainer 16 where a spacer 24 has not been formed, an aperture 26 is provided through the base 20 of retainer 16, the apertures 26 thus communicating with the interrupted slots 22. A printed circuit board connector pin 28 is press fit into each of apertures 26. Pins 28 will typically extend out of slots 22, i.e., the pins will terminate above the "floor" 74 defined in part by the tops of spacers 24.

Printed circuit board connector pins 28 are comprised of an electrically conductive material. Each has an approximately cane shape with a straight body portion and a curved head. The straight elongated upper end or upper rod portion 29 of the pin 28 extends through apertures 26 to form an electrical and frictional connection between adjacent loops of a conductive element. The curved portion 31 of the pin 28 has a arcuate base 33 which diverges to a contact point 35. A short linear extension 37 is integrally attached to the other side of contact point 35 and points inwardly toward rod portion 29. As will be discussed hereinafter, in a preferred embodiment, the pins 28 also include a detent structure 45 for secure engagement within the retainer 16 and a U-shape guide member for accurate insertion therein.

As best shown in FIG. 1, the contact points 35 of a pair of inwardly facing or opposing pins 28 define each individual printed circuit board connector clip 17. This particular arrangement of pins 28 permits the curved portions 31 to act as bias elements when a P.C. board is inserted therebetween. In a preferred embodiment, this bias action is further enhanced by the presence of a slot 61 longitudinally located along the middle of the contact area of the pin 28 as clearly shown in FIG. 5. The bifurcated contact points 35 will effect improved contact, especially if the printed circuit board has an uneven surface area. The distance or space 39 between the inwardly facing contact points 35 must be slightly less than the width of a standard printed circuit board. Thus, upon insertion of a P.C. board into the space 39 between the curved portions 31 of the pins 28, the pins 28 are initially deflected outwardly resulting in a tight spring force holding the circuit boards therein and effecting electrical connection. After insertion, the entrance end of the P.C. board (not shown) is supported by recess 55 in retainer 16. It should be obvious to one skilled in the art that a board having printed circuitry on both one or two sides (and with or without interconnection between the sides of the P.C. board) may be utilized in conjunction with the present invention.

The retainer 16 of the present invention has preferably a solid molded structure which will adequately support pins 28. Thus, upper side walls 41 give support to the rod portion 29 of pin 28. Retainer 16 also includes inclined guide surfaces 43 which support and bear against the linear extension 37. Thus, when the bias curved portion 31 of the pins 28 perform as bias elements and deflect outwardly (upon insertion of a P.C. board), the extensions 37 will slide down upwardly and outwardly against inclined guide surfaces 43 and will force the lower rod sections 57 against walls 59 to effect the tight spring force for gripping the printed circuit board. Similarly, when the P.C. board is withdrawn, the extensions 37 will be permitted to slide back down the inclined surfaces 43 to assume its unloaded position. Guide surface 43 also acts as a camming surface to facilitate positioning of the pin 28 as it is inserted into the retainer 16. As noted, the P.C. board will rest inside recess 55 after insertion into retainer 16.

Figure 5:
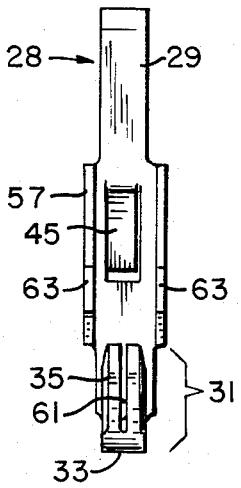
FIG. 5 is a front view of a pin from a connector clip in accordance with the present invention.
Figure 3:
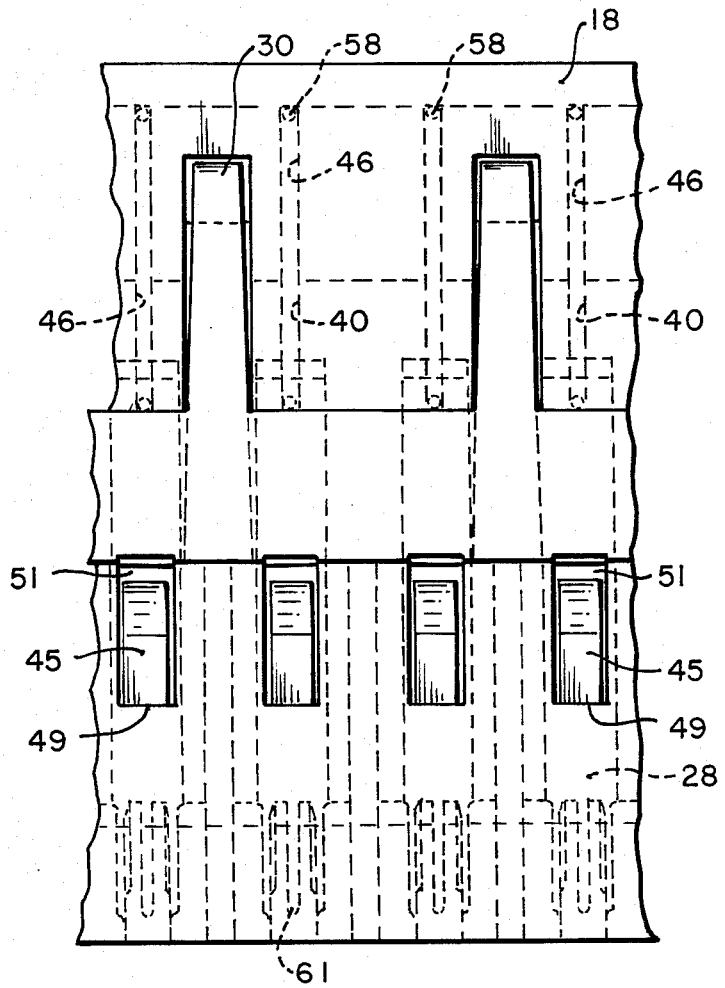
FIG. 3 is a side elevation view along line 3—3 of FIG. 1 in accordance with the present invention.

Referring now to FIGS. 1, 3 and 5, in a preferred embodiment, each pin 28 has a detent structure 45 which cooperates with an open area 47 in the retainer 16 to lock the pin therein. The detent 45 also acts as a stopping mechanism to accurately monitor the length of the pin 28 which engages the loops. The detent 45 is either integrally formed from the rod portion 29 of the pin 28 or comprises a separately attached member. Detent 45 is springy so that it can be deflected inwardly and then can be snapped out into place to effect the locking of pin 28 in retainer 16. Thus, upon insertion of the pin 28 into the retainer 16, the wing-shaped detent 45 is inwardly bent back and is subsequently snap-locked along the retaining shoulder 49 in open area 47. The open area 47 is bounded by window 51 which permits access to the detent mechanism 45. When removal of the pin 28 is desired, the detent 45 can be manually bent back by insertion of fingers through the windows. As soon as the detent is pushed through the open area 47, the pin 28 is pulled upward and out of the retainer. Preferably, a U-shaped guide member 63 is formed in the general area of the detent structure 45. Thus, as a pin 28 is inserted into the retainer 16, the guide member 63 will guide and support the pin 28 as it slides in between upper side wall 41 and walls 59. As with the detent 45, the guide member 63 may be either integrally formed from or separately attached to the pin 28.

Retainer 16 also has a plurality of locking arms 30 which extend upwardly from base 20 along each side of the retainer. Locking arms 30 are slightly resilient and springy, so that they can be deflected outwardly and then spring or snap back into place to lock retainer 16 and main body unit 18 together. The upper part of each locking arm 30 has an inwardly projecting locking surface or shoulder 32 which engages a corresponding locking surface or shoulder 34 on main body unit 18.

Referring now to FIG. 4, main body unit 18 has a main body portion 36 with two fanning strips, defined by posts 38, running along each side. The fanning strips serve as a means of orderly entry into the block for the insulated conductors of a communications cable or system which are to be electrically connected to solderless connectors in the block. Main body unit 18 includes, in body portion 36, a plurality of longitudinal slots 40 (as seen IN FIG. 3) which correspond to and are in alignment with each of the latitudinal slots 22 in base 20 of retainer 16. Body unit 18 has an internal floor or surface area 42 from which a series of inverted U-shaped bridges 44, which are integrally molded parts of main body unit 18, project. The outermost bridges 44 are integral with posts 38 of the fanning strips. Each bridge 44 has a passage or opening 46 in alignment with the slots 22 and 40. As will be described in more detail hereinafter, the slots 22 and 40 and the passages 46 serve to house and position rows of wire formed solderless connectors. It will, of course, be understood that all of the bridges 44 are of similar construction, so only illustrative ones are marked in the drawings. As best shown in FIG. 4, the bridges are spaced apart to define open rows 54 in which to run wires from the fanning strips. As may be seen from FIG. 4, the bridges 44 are also spaced to define columns 56 through which access is had to connect the conductors of wires to the connector elements housed in the block.

With reference to FIG. 1, a wire formed solderless connector is indicated generally at 58. Connector 58 is formed from any suitable electrically conductive wire stock having sufficient resiliency. The wire stock is bent to form two coplanar opposite facing rows of loops 60 and 62, respectively. The loops of upper row 60 are formed with straight parallel sides 64, while the loops of lower row 62 are formed with inwardly converging sides 66. The radius of the curved portion of lower loops 62 is less than that of the curved portion which connects the straight sides of the upper loops 60. The straight parallel sides 64 of adjacent of the upper loops 60 are in contact and define therebetween individual connectors. In use, an insulated wire conductor, not shown, is inserted between two adjacent sides 64. As the wire is forced downwardly between two adjacent loops in row 60, any insulation is sheared away at the contact point between the upper loop sections. This shearing action is partly a result of the dimensioning of passages 46 which retains the connectors against lateral movement. This shearing action is diminished as the conductor is forced between the sides 64, since these sides 64 are allowed to bow outwardly. Restated, the multiple terminal connectors 58 function as end-supported beams.

The loops in row 62 are spatially separated from each other to allow the positioning of spacers 24 or P.C. board connector pins 28 between them. This spatial separation is selected to allow the loops to firmly grasp the P.C. board connector pins 28 and maintain a good electrical connection thereto. The spacers 24 and pins 28 are sized and shaped so as to preclude relative movement between loops 62 after the connecter block has been assembled.

In assembling a block in accordance with the present invention, the wire formed solderless connectors 58, one of such row type connectors being clearly seen in FIG. 2, are loaded into the slots 40 of main body unit 18. Retainer 16, having at least one P.C. board connector clip incorporated therein, is then placed in position relative to the main body unit, with the slots 22 in alignment with the connectors 58, and the base and main body unit are then moved together to come into locking engagement. As can best be seen in FIG. 1, the innermost extension of shoulder 32 on the locking arms 30 overlaps main body surfaces 68 over which the arms must slide in assembling the unit. Thus, when assembling the unit, the inclined surfaces 70 on arms 30 will be engaged by surfaces 68, whereby the locking arms 30 are cammed and deflected outwardly as retainer 16 and main body unit 18 are moved together. When the retainer and main body unit have been positioned so that the bottom 72 of body portion 36 is adjacent to the floor 74 of retainer body 20, the locking arms snap inwardly with locking shoulder 32 overlapping cooperating shoulder 34 to complete the assembly of the block. In this manner, the wire formed connector strips are locked and retained in place in the block and are ready to receive single or plural, insulated or bare, single conductor or stranded wires to be mounted thereon as well as P.C. boards to be inserted into the connector clips. During this assembly procedure, the pins 26 and the spacers 24 will be forced between lower loops 62 of the connector element 58.

Referring to FIGS. 2 and 4, each row of wire connectors 58 is fully retained against movement or deflection toward any adjacent row, since the lower loops of each wire connector row are fully captured in a slot 22 and the connector rows are also captured in slots 40 and the bridge passages 46 in the bridges 44. Thus, each wire connector row is fully constrained against displacement which would create misalignment and interfere with the insertion of wires.

The connector block 18 not only retains each row of wire-formed connectors against deflection toward an adjacent row, but also resists lateral deflection of each connector row when a conductor is inserted therebetween. As clearly seen in FIGS. 2 and 4, each wire-formed multiple connector 58 is snuggly captured within slots 40 of main body 18. The upper outer loops at each end of each connector are retained against outward movement by the upper side walls 76 of the posts 38.

The upper loops or portions of the wire-formed connectors 58 are retained and stiffened within the blocks 10. Since the upper loop portions of the wire connectors are prevented from lateral movement when an electric wire is inserted therebetween, wire insertion results in a high compression force which strips away the insulation from the conductor of the wire. This compressive force decreases as the conductor is forced downwardly between a pair of cooperating loops of the connector, since the two straight portions of the wire connector are allowed to bend outwardly as shown in FIG. 1. This prevents cold flow of the conductor as it is inserted into the connector. Thus, to summarize, the loops of the wire-formed connector generate a high force upon initial wire insertion and the high force strips any insulation from the wire. When fully inserted, however, the wire is positioned between straight sections of the connector, i.e., between straight sections of end supported beams which can bend. The application of a force which is initially high and which decreases in the direction of wire insertion is completely contrary to prior art practice.

The actual mechanical and electrical connection of conductor wire to the wire connector 58 will, typically, be effected by means of a wire insertion tool somewhat similar to the general type presently used for inserting wires into "66 Type" connectors of the type shown in U.S. Pat. No. 3,132,913. A tool designed for use with the connector block of the present invention is disclosed in my co-pending application Ser. No. 233,983 filed Feb. 12, 1981, now U.S. Pat. No. 4,408,391 and assigned to the assignee of the present invention. Mechanical and electrical connection of a wire conductor to the connector 58 is effected by forcing the wire downwardly between adjacent loops of wire connector 58. The wire conductor will typically be forced down to floor 42. As this happens, as described above, the insulation is sheared and adjacent straight sections of the loops of the connector are subsequently urged apart, and generate strong spring return forces, so that firm physical and electrical contact is established between the wire core of the electrical conductor and the adjacent loop surfaces of the wire connector 58.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A block for housing electrically conductive wire-formed connector elements of the type having oppositely facing and interconnected upper and low rows of loops, the block including:

a retainer section, said retainer section having opposite first and second surfaces;

a plurality of rows of spaced slots in said retainer section first surface;

at least some of said spaced slots of said retainer section being provided with apertures and spacers, said apertures and said spacers each being positioned so as to be equidistant from the centers of an adjacent pair or loops of a connector element, said apertures communicating with said retainer section second surface, each of said spacers being a protrusion which will be positioned between and in contact with two adjacent lower loops of a connector element;

at least a pair of elongated electrically conductive printed circuit board connector pin means, said pin means being positioned and retained within said apertures of said spaced slots, a first end of said pin means extending outwardly beyond said first surface of said retainer section wherein said extended pin means first end is capable of being positioned between and in electrical contact with two adjacent lower loops of a connector element, a second end of said pin means having incorporated thereon a printed circuit board receiving means, a pair of said receiving means capable of electrical and mechanical connection and defining a printed circuit board connector clip;

a main body section;

a plurality of rows of spaced slots in said main body section in alignment with corresponding rows of slots in said retainer section;

a plurality of bridge elements on said main body section in bridging alignment with the slots in each row of said main body section, each bridge element defining a passage in alignment with corresponding slots in the main body section and the retainer section;

said corresponding retainer slots, main body slots and bridge passages in each main body section cooperating to define housings for electrically conductive wire connector elements;

said bridge elements in each row being spaced apart and in alignment with bridge elements in other rows to define spaced columns for connection of electrical conductors to wire connector elements; and means for releasably joining said retainer section and said main body section together.

2. A block as in claim 1 wherein:

said main body section has a floor spaced from said retainer section; and said bridge elements extend from said floor away from said retainer section.

3. A block as in claim 1 wherein said receiving means includes:

a curved portion, said curved portion having a arcuate base which diverges to a contact point.

4. A block as in claim 3 wherein a pair of said receiving means are oppositely disposed to define a printed circuit board connector clip.

5. A block as in claim 3 further including:

a linear extension integrally attached to said contact point, said extension pointing inwardly toward said connector pin means.

6. A block as in claim 5 wherein said retainer section further includes:

a pair of inclined guide surfaces which support said linear extensions after said pin means are inserted into said retainer.

7. A block as in claim 3 wherein:

said curved position has a longitudinal slot therein.

8. A block as in claim 1 wherein said retainer section further includes:

a pair of guide surfaces; and a recess, said recess located between said pair of guide surfaces and capable of accepting a printed circuit board.

9. A block as in claim 1 wherein said pin means includes:

a detent attached to said pin means, said detent effecting a snap lock of said pin means within said retainer section.

10. A block as in claim 9 wherein said retainer section includes:

at least a pair of open areas, said open areas capable of accepting said detent;

a shoulder bounding said open area, said shoulder retaining said detent after said snap lock; and a window, said window providing access to disengage said detent whereby said pin means is removed from said retainer.

11. A block as in claim 1 wherein said pin means further includes:

a guide member to effect accurate placement in said retainer section.

12. A block as in claim 11 wherein said guide member has a U-shape.

13. A block as in claim 1 wherein:

said releasable joining means includes locking arms extending from said retainer section, and locking surfaces on said main body section for locking engagement with said locking arms.

14. A block as in claim 1 wherein:

each of said slots in said main body section is dimensioned to restrain the electrically conductive wire connector element from lateral movement.

15. A block as in claim 2 wherein said bridge elements are aligned in rows and wherein the passages in the bridge elements at the opposite ends of each row are in the form of U-shaped slots, the wire connector elements engaging the bottoms of said U-shaped slots.

* * * * *